United States Patent [19]

Figueroa

[11] 3,975,022

[45] Aug. 17, 1976

[54] PARLOR GAME DEVICE

[76] Inventor: Luisito A. Figueroa, 39 Banaba Road, Forbes Park, Makati, Rizal, Philippines, 3116

[22] Filed: Feb. 26, 1975

[21] Appl. No.: 553,090

[52] U.S. Cl. ..... 273/141 A; 200/38 B; 200/153 LB; 273/142 JA

[51] Int. Cl.[2] ..... A63F 5/04

[58] Field of Search..... 273/138 A, 139, 141 A, 273/141 R, 142 H, 142 R, 142 A, 142 B, 142 C, 142 D, 142 E, 142 F, 142 G, 142 HA, 142 J, 142 JA, 142 JB, 142 JC, 142 JD, 142 K, 143 R, 143 A, 143 B, 143 C, 143 D, 143 E; 40/52 R, 52 A, 52 B, 130 L, 33; 200/38 B, 38 BA, 153 LB

[56] References Cited

UNITED STATES PATENTS

| | | | |
|---|---|---|---|
| 1,635,735 | 7/1927 | Ziegler | 273/141 R X |
| 1,752,089 | 3/1930 | Hynes | 273/141 R |
| 2,095,367 | 10/1937 | Mattson | 273/142 HA |
| 2,175,892 | 10/1939 | Greene | 273/141 A |
| 2,193,478 | 3/1940 | Diebel | 273/141 A X |
| 2,619,348 | 11/1952 | Woodin | 273/141 A X |
| 2,667,354 | 1/1954 | Mathews et al. | 273/141 A |
| 2,717,158 | 9/1955 | Dieterich | 273/141 A |
| 2,799,500 | 7/1957 | Zekowski | 273/141 A X |
| 3,384,375 | 5/1968 | Zifferblatt | 273/138 A UX |

FOREIGN PATENTS OR APPLICATIONS

| | | | |
|---|---|---|---|
| 280,649 | 4/1967 | Australia | 273/138 A |

*Primary Examiner*—Richard C. Pinkham
*Assistant Examiner*—Arnold W. Kramer

[57] ABSTRACT

This invention is concerned with an electrically operated game device wherein a number selector means consisting of at least two electrically actuated spinnable pointers are provided to select or indicate at random a set of numbers, which numbers form possible arithmetical combinations. The rotation of each of said spinnable pointers is made variable and sequential by the use of a timing device. A horizontally disposed playing glass panel is disposed forwardly of said number selector means, said playing panel having several transverse rows of numerical indicia outlined thereon whereby all the possible arithmetical combinations arising from the randomly indicated numbers could be reflected thereon. An electrical control panel is provided wherein a set of switches are provided to actuate the number selector means and the lighting means disposed on said playing panel.

2 Claims, 11 Drawing Figures

PARLOR GAME DEVICE

This invention relates to a parlor game device for playing a very simple yet interesting and challenging game.

The invention has for its object to provide a parlor game device which can be played by more than two opposing players at the same time. The method of playing the game in conjunction with the device is very simple and requires simple arithmetic so as to be playable by almost anyone.

Another object of the invention is to provide a game device construction which could be arranged to occupy a negligible floor space. This makes the device ideal for use in crowded amusement houses.

Briefly described, the parlor game device consists of three subassemblies, namely, a number selector means for randomly selecting or indicating a set of numbers, said selector means consisting of at least two electrically actuated spinnable pointers, the rotation of each being made variable and sequential by the use of a timing device to indicate randomly a set of numbers; a horizontally disposed playing glass panel having several transverse rows of numerical indicia whereby all of the possible arithmetical combinations obtainable on said randomly selected set of numbers could be reflected thereon; and an electrical control panel for said electrically operated number selector means and for actuating suitable indicating and lighting means disposed on said playing panel.

Each of the numerical indicia on the playing panel are arithmetical combinations of the set of numbers indicated by the number selector means, and each is assigned a probability points value in accordance with the odds of obtaining the combination. For every given play, the number selector means will indicate a set of numbers and the possible arithmetical combinations arising therefrom, that is, low and high numerical sums, two of a kind, three of a kind, fractions, etc., are given corresponding probability points value. For instance, the three of a kind combination if there is a set of three numbers is given premium points value as it is considered the most difficult to obtain.

In playing the game, all the players are given differently colored set of markers and each player will place a marker on any numeral indicia of his choice. For a predetermined number of plays, all the markers will have to be expended and the player who garners the most number of points wins the game.

Other objects and features of the invention will become apparent from the following description which should be taken in conjunction with the appended drawings for a better understanding.

Figure 1:
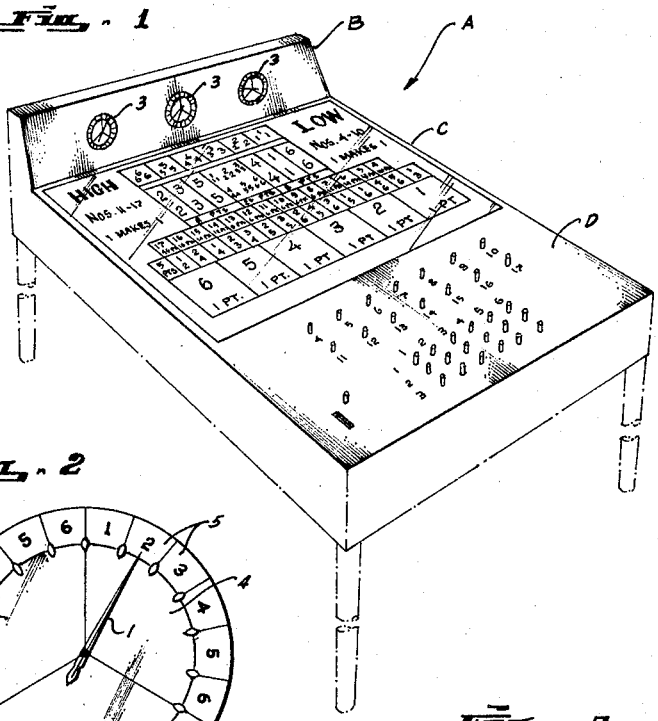
FIG. 1 is a perspective view of the game device in accordance with the preferred embodiment of the invention.
Figure 2:
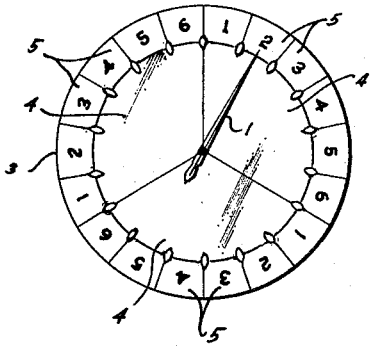
FIG. 2 is an enlarged front view of a unit of the number selector means shown in FIG. 1.

Referring to the drawings in detail, there is shown in FIG. 1 a parlor game device generally designated as A consisting of three main components, namely, the number selector subassembly B; the playing glass panel C and the Electrical control panel D, said components being operably connected with respect to each other.

The number selector subassembly B consists of a housing H wherein at least two identical number selector means are secured therein. Each of said number selector means comprises a spinnable pointer 1 each of which is connected to the shaft of the flywheel 2 which flywheel shaft is coupled by means of a flexible coupling to the shaft **2*a* of the respective identical electric motors 7,8 and 9. The flywheel shaft extends through an opening 2*b* which is provided on the front wall of said housing H. A pair of pillow block bearings 2*c* rotatably support said flywheel shaft to prevent vibration and thereby smoothen the rotation of the spinnable pointer 1.**

At the front wall of said housing and concentric with each of said opening **2*b* is a circle defining a circular band 3, each of which is divided into three groups of equal sectors 4, each group of sector being comprised of six equal radial segments 5 numbered one to six. In-between each number on said radial segments is fixedly secured therewith studs 6, each of said studs being so disposed to have equal radius such that the flexible tip of the spinnable pointer 1** contacts said studs during rotation. Each stud is rhombic in form or any of such form for the purpose of breaking the momentum of the spinnable pointer at minimum resistance and to give a spring action out of a questionable position of the flexible tip which may settle in-between immediately adjoining numbers bounded by the studs.

Figure 5:
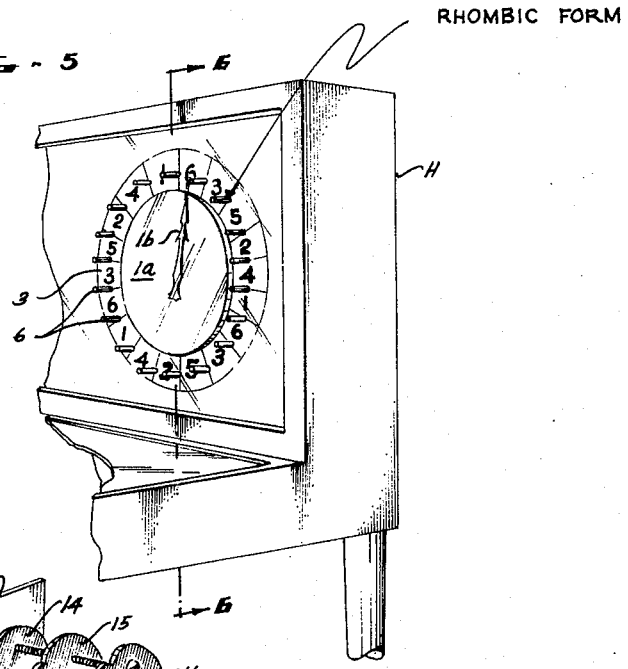
FIG. 5 is a fragmentary, perspective view of a unit of the number selector means showing a modification of its spinnable pointers.

Another modification of the spinnable pointer 1 is shown in FIG. 5. In said modification, the spinnable pointer is of a rotating disc **1*a* having an imprinted arrow 1*b* on its surface extending diametrically thereof including its flexible tip. Said rotating disc is secured to the shaft of the flywheel 2 and freely rotates on the front wall of said housing. The diameter of said rotating disc is such that it will not cover the numbers on the radial segments 5 of the circular band 3.**

The flexible tip of said spinnable pointer consists of a coil spring **1*c* secured at the tip of imprinted arrow 1*b* and having a rubber extension 1*d* of predetermined length. Said rubber extension contacts each of said studs 6 during rotation. In case of questionable position of the rubber tip 1*d*, the position of the imprinted arrow 1*b*** on said rotating disc prevails.

Figure 7:
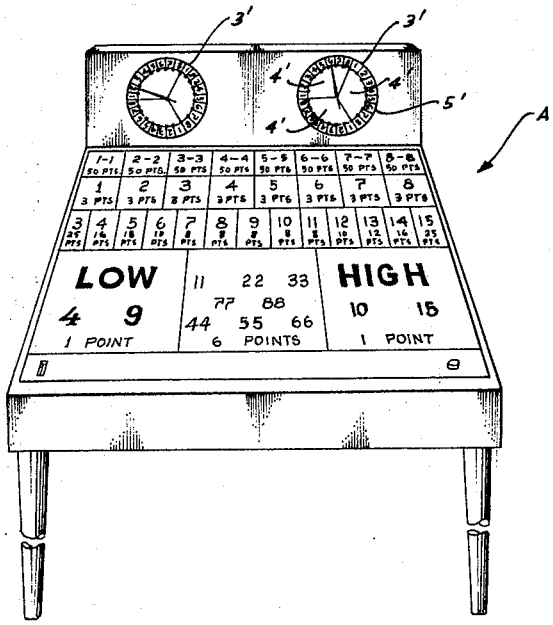
FIG. 7 is a perspective view showing another embodiment of the game device utilizing only two number selector means.
Figure 6:
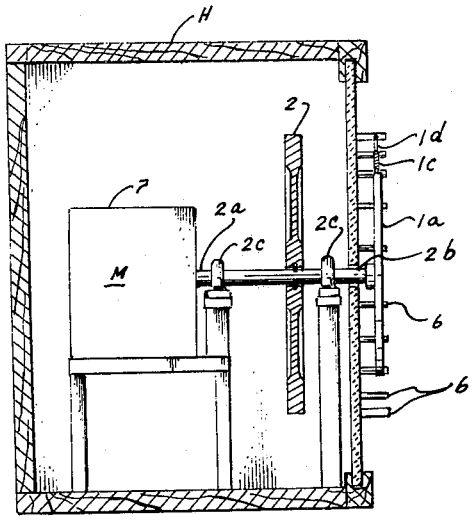
FIG. 6 is a cross-sectional view taken along line 6—6 of FIG. 5.
Figure 3:
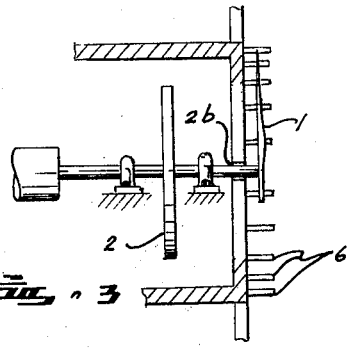
FIG. 3 is a fragmentary sectional view of a unit of the number selector means used in FIG. 1.
Figure 4:
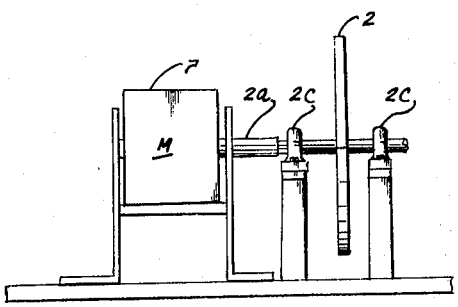
FIG. 4 is a side view showing the mounting of the electric motor and flywheel assembly for the number selector means.

In the embodiment shown in FIG. 7, the circular band 3′ are each divided into three sector groups 4′ each sector being comprised of eight equal radial segments 5′ numbered one to eight. In short, the circular band may be subdivided into any number of sectors and each sector being radially segmented into any number of segments. The arrangement of the numbers on said radial segments may not necessarily be serially numbered as it could be of any series of numbers desired.

For any given play, the number selectors indicate any number in any of the sector groups of said circular bands 3 and 3'. The spinnable pointers are of such length such that the flexible tip thereof extend slightly beyond the studs 6.

Electrical Function as follows

Figure 11:
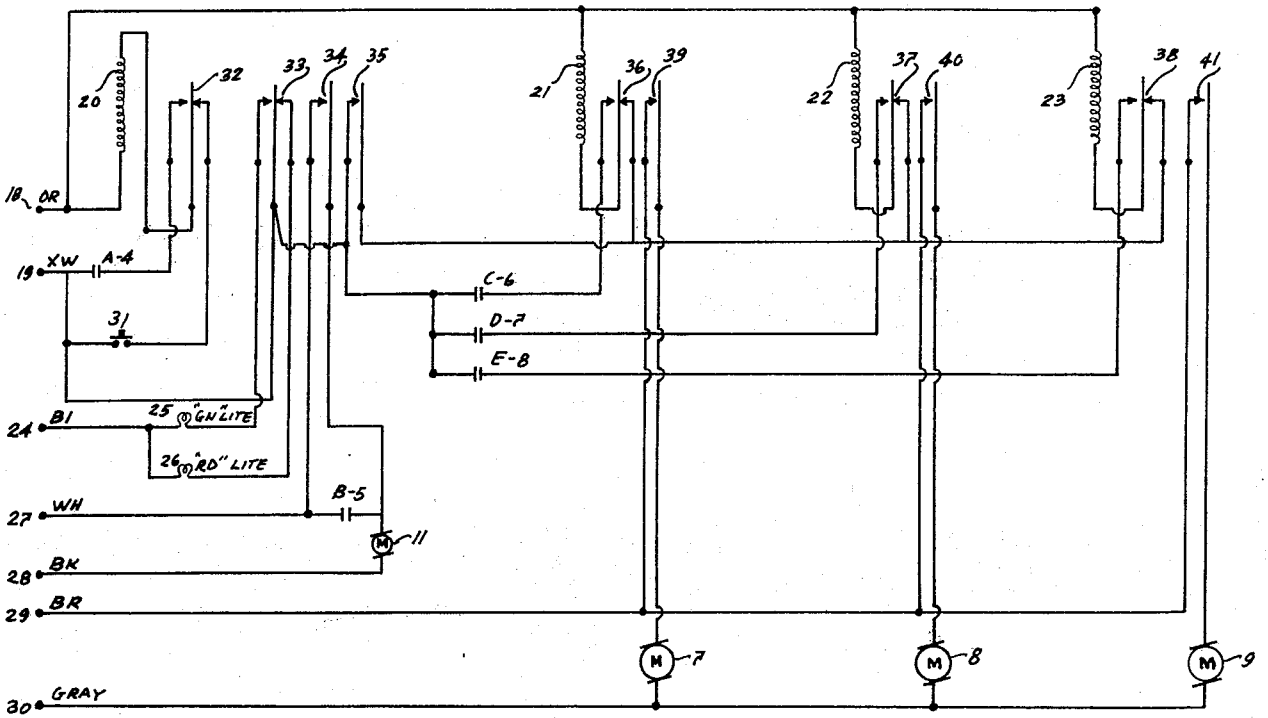
FIG. 11 is a schematic circuit diagram of the timing device and the number selector means.
Figure 10:
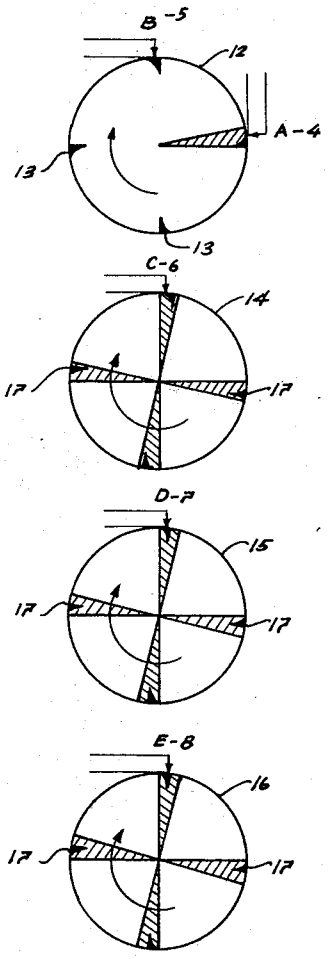
FIG. 10 is a schematic view of each of the cam switches used in FIG. 8.

The electrically actuated pointers 1 are rotated in such a manner that the motors 7,8,9, are subsequently de-energised. As shown in FIG. 11, there are three motor circuits for the spinnable pointers 1, however, two motor circuits or any number could be made. The variability of the sequential de-energising of the motors 7, 8, and 9 are controlled by the main timing device, the detailed description of which will hereinafter be explained.

The playing glass panel C is mounted on a table 10 having several rows of numeral indicia 10a. The numbers and words thereon are transparently outlined against a translucent background in order to visually recognise that combinations are obtainable once the lighting means behind the combinations are electrically actuated. The electrical circuit for actuating the indicating lighting means is conventional in nature and do not require detailed elaboration.

Adjacent the playing glass panel, is the electrical control panel D which consists of a set of push button switches **10*b* for each of the numbers in each of the circular bands 3 and 3' and the high and the low sums thereof. For example, if the electrically actuated pointers 1 in FIG. 1 indicate the numbers 2, 5 and 6, the button switch 2 is actuated in the first row of the buttons numbered 1 to 6, the button 5 in the second row and the button switch 6 in the third row. Thereby, all the numbers 2, 5 and 6 and the possible arithmetical combinations thereof are lighted on the playing glass panel, i.e., the combinations "2 and 5"; "2 and d6"; and "5 and 6" are lighted automatically upon pressing the buttons. Similarly, the numbers 2, 5 and 6 summed up and the sum thereof which is 13 falls under the high numerical sums row and thus, the button corresponding to the sum is actuated and the result is reflected on the playing glass panel C. The number 13 and the word "HI" are lighted. The same rules apply in the embodiment shown in FIG. 7.**

Figure 8:
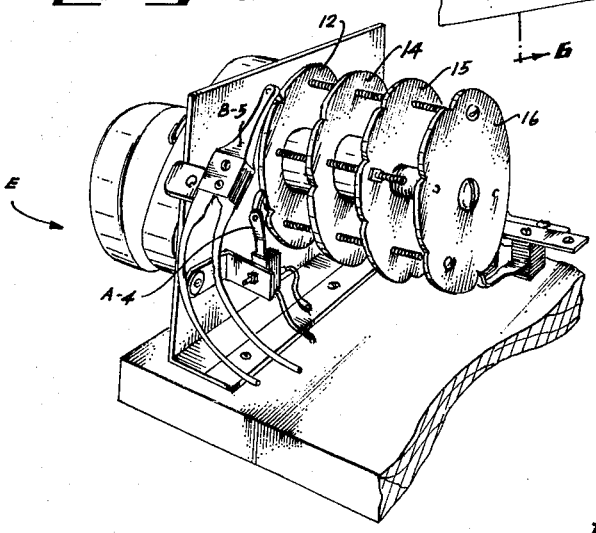
FIG. 8 is a perspective view of the timing device used to actuate the number selector means.
Figure 9:
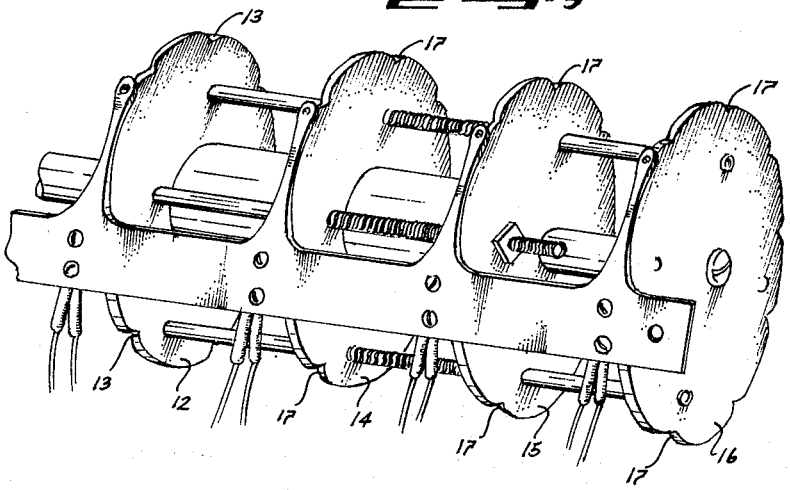
FIG. 9 is an enlarged rear view of the cam switches used in FIG. 8.

As previously stated, the number selector means randomly indicate a set of numbers to obtain an arithmetical combination. The random selection of said set of numbers is controlled by the main timing device E, (FIG. 8) to effect the sequential de-energizing of the motors 7, 8, 9 of the spinnable pointers 1.

As shown in FIGS. 8, 9, and 10 and 11, said timing device E consist of a 110 volt timing motor 11 of very low speed such as ⅓ RPM motor, the shaft of which is connected with a four-ganged cam switches for operating the spinnable pointer motors 7, 8, 9. The first cam 12 has at least four equal symmetrically positioned actuating notches 13 to activate the cam switches A-4 and B-5. The second cam 14, third cam 15 and fourth cam 16 have also at least four actuating notches 17 to activate cam's switches C-6; D-7 and E-8, respectively. The activating position of the notches are not symmetrically positioned in each cam but will lie in-between the four shaded position of each cam diagrammatically shown in FIGS. 10. The number of notches on each cam depends on the different time sequencies desired.

The variability of this position will ensure that the three spinnable pointer motors will not stop simultaneously but may vary in any sequence such as first, then second then third, if a three number selector means is used; or, second, then third, then first or third; then second, then first, etc.

The circuit diagram shown in FIG. 11 illustrates how the timing device E operates when power is first applied to the circuit.

The orange wire 18 and yellow wire 19 has an applied voltage of 50 volts A.C. which is the energizing voltage of the relay coils 20, 21, 22 and 23. The yellow wire 19 and the blue wire 24 has an applied voltage of 6 volts A.C. which is the rated voltage of the indicating green light 25 and red light 26. When connected to a power source, the red light 26 is lighted indicating that the relays are not energized, or that the motor circuits are open, and when energized, the red light is "OFF" and the green light 25 is lighted. The white wire 27 and the black wire 28 has an applied voltage of 110 Volts A.C., which is rated voltage of the timer motor 11. The brown wire 29 and the gray wire 30 has an applied voltage of 24 volts A.C. which is the rated voltage of the spinnable pointer motors 7, 8 and 9. All of these secondary voltages come from a single power source with a primary voltage of 220/110 volts power transformer (not shown). However, the secondary voltages may vary depending on the rated voltage of the energizing relay coils 20, 21, 22 and 23 and/or the indicating light bulbs 25 and 26 and the motors 7, 8 and 9. When initially, power is applied, Cam switch B-5 on the first cam 12 will ensure that the four-ganged cams will rotate to its initial starting position, which is when the cam switch B-5 will be opened at any of the four symmetrically positioned notch, for if it will not be in that position, cam switch B-5 will be closed, thus completing the circuit of the timer motor 11 energising it to rotate continuously until Cam switch B-5 will be opened at any of the four symmetrically positioned notch 13 of the first cam 12. This function ensures that the four cams are at their starting position, i.e., cam switch A-4 is closed initially resting on the first cam 12, Cam switch C-6, D-7 and E-8 are also closed initially resting on the cams 14, 15 and 16, respectively.

OPERATION

To start the spinnable pointer motors in motion, the operator has to press the start button 31 momentarily, and the three spinnable pointer motors 7, 8 and 9 will rotate immediately for at least a certain length of time depending upon the length of time for the timer motor 11 to rotate the cam to cover the arc distance in-between two adjacently positioned notches of the timer motor cams and will stop automatically in any of the sequences mentioned before, depending on where the cam switch A-4 has rested on its preceding rotation.

Pressing the start button 31 energizes the holding relay 20 through one of its normally closed single-pole-double throw switch (SPDT) blade 32. The relay will be energized and remains energized through cam switch A-4 (which is initially closed) until said cam-switch will be opened when a notch passes through said cam-switch A-4. When the holding relay 20 is energized, the second SPDT switch blade 33 will be actuated, thereby opening the circuit of the red light 26 and closing the circuit of the green light 25 to indicate that the three pointer motors 7, 8 and 9 are energized. At the same time the holding relay 20 will energize the timer motor 11 through the normally open switch blade 34. The timer motor will remain energized as long as the holding relay 20 is energized and when said holding relay is de-energized, the timer motor 11 still remains energized since cam switch B-5 would have been closed by the time the holding relay 20 is de-energized. It will remain closed to continuously energise the timer motor until the cams rotate to any one of its starting positions, that is, when cam switch B-5 opens at one of the four symmetrically positioned notches which is the starting position of the next play of the game.

When the holding relay 20 is energised, the other normally open switch blade 35 will close and complete the circuit of the three succeeding spinnable pointer motor coil relays 21, 22 and 23 through their respective SPDT switch blades 36, 37 and 38. Once said motor relay coils are energised, they will remain energised until cam switches C-6, D-7 and E-8 of the cams 14, 15 and 16, respectively, would be opened by the notch 17 when said notch passes beneath the cams' switches in any of the manner of sequence mentioned earlier. Each of the normally open switch blade 39, 40 and 41 of the three motor relays 21, 22 and 23 directly completes the 24 volts circuit of the pointer motors 7, 8 and 9. The length of time that the pointer motors are energized depends on the length of time that the pointer motor relays are energized. Said length of time that said pointer motors remain energised depends in turn upon the length of time that cam switches C-6, D-7 and E-8 remain closed until it opens when a notch passes below them in a variable sequential order which is dependent upon the relative positions of the notches. 17 on the shaded area portion of the cams. From the foregoing description, it will be apparent that various changes maybe made in the form, construction and arrangement of the parts without departing from the spirit and scope of the invention or sacrificing all of its material advantages, the form hereinbefore described being merely a preferred embodiment.

I claim:

1. An electrically operated game device comprising a number selector means including at least two spinnable pointers each mounted centrally of an opening; a circular band defined on the wall of each opening and concentric therewith, said circular bands each being divided into a predetermined number of sector groups with each sector group being comprised of numbered radial segments; a plurality of studs each secured in-between said radial segments and cooperable with means on said pointers for indexing said pointers; timing circuit means operably connected to said pointers to control the sequential and variable rotation thereof to randomly indicate a number in any of said sector groups; said timing circuit means including a motor driven gang of switch-actuating cams, said gang including a first cam having a plurality of equally, symetrically positioned actuating notches for opening two circumferentially spaced switches each cammed by the first cam when the respective switches are indexed by a respective notch, said gang further including an additional cam for each respective pointer, each said additional cam having the same plurality of notches as the first cam but having the actuating notches unsymetrically positioned thereon, a switch controlled by each additional cam which switch actuates a motor for turning its respective pointer, and a player operable start button, whereby on actuation of the start button the motor driving the ganged cam switches is initially actuated and is maintained actuated by one of the switches cammed by the first cam, while the additional cams actuate their associated switches to rotate the pointer motors until such associated switches are opened at the cam notches, whereby the said one switch of the first cam is opened at the next notch with the cam motor still maintaining driving rotation under the control of the now closed second switch associated with the first cam until said second switch is opened at the next notch occuring on the first cam to complete one overall actuation of the device.

2. An electrically operated game device according to claim 1 wherein each of said spinnable pointers consists of a rotating disc fixed to a shaft; an arrow imprinted diametrically on said disc, a coil spring fixedly secured at the tip of said arrow and a rubber extension projecting at the end thereof and adapted to engage said plurality of studs disposed on said radial segments, said studs being rhombic in form for the purpose of breaking the momentum of the spinnable pointer at minimum resistance and to give a spring action out of a questionable position of the flexible tip which may settle in-between immediately adjoining numbers bounded by the studs; and a flywheel on the shaft of said disc.

* * * * *